US006808243B1

(12) United States Patent
Markham et al.

(10) Patent No.: US 6,808,243 B1
(45) Date of Patent: Oct. 26, 2004

(54) THERMAL INKJET PRINT HEAD WITH BLENDED ENABLE TRAINS

(75) Inventors: Roger Guy Markham, Webster, NY (US); Ray Wartinger, Webster, NY (US)

(73) Assignee: Xerox Corporation, Stamford, CT (US)

( * ) Notice: Subject to any disclaimer, the term of this patent is extended or adjusted under 35 U.S.C. 154(b) by 16 days.

(21) Appl. No.: 10/442,222

(22) Filed: May 20, 2003

(51) Int. Cl.[7] ..... B41J 2/05
(52) U.S. Cl. ..... 347/14; 347/17; 347/60
(58) Field of Search ..... 347/14, 17, 60, 347/11, 185

(56) References Cited

U.S. PATENT DOCUMENTS 4,490,728 A 12/1984 Vaught et al. ..... 346/1.1
5,036,337 A 7/1991 Rezanka ..... 346/1.1
5,107,276 A 4/1992 Kneezel et al. ..... 346/1.1
5,736,995 A * 4/1998 Bohorquez et al. ..... 347/14
6,390,585 B1 * 5/2002 Schiaffino et al. ..... 347/17
6,422,677 B1 7/2002 Deshpande et al. ..... 347/14

* cited by examiner

*Primary Examiner*—Lamson D Nguyen
(74) *Attorney, Agent, or Firm*—Perman & Green, LLP

(57) ABSTRACT

A series of enable trains are designed to provide a predetermined increment of heat to the heating element of a thermal ink jet printer printhead. The enable trains are stored in tabular form in memory according to printhead temperature. The printhead temperature is sensed during the printing cycle and read by the printhead controller. The controller selects a enable train from the table and applies it to the heating element. When subsequent cycles call for a change in the enable train, the current enable train is blended with the new enable train to provide an average increment of heat.

12 Claims, 9 Drawing Sheets

THERMAL INKJET PRINT HEAD WITH BLENDED ENABLE TRAINS

BACKGROUND OF THE INVENTION

1. Field of the Invention

This invention relates to thermal ink jet printing devices and more particularly to thermal ink jet printheads having an extended operating temperature range over which the volume of ejected ink droplets may be controlled.

2. Brief Description of Related Developments

In the thermal ink jet printing process, a short duration voltage pulse is applied to the heating elements of the printhead, which raises the surface temperature of the heating elements very rapidly. The ink in the neighborhood of the heating element is superheated and a vapor bubble is nucleated at the heating element surface. The bubble begins to expand under the influence of the high initial vapor pressure and continues to expand due to inertial effects, ejecting an ink droplet from the printhead nozzles. The pressure inside the bubble immediately begins to decrease because of the evaporation at the ink vapor interface with the heating element surface. The evaporation process extracts heat from the heated ink and the ink temperature slowly decreases. To some extent, the growth of the bubble and, therefore, the associated volume of the ejected ink droplet depend on the amount of energy available in the ink near the ink vapor interface. Only a small fraction of the input energy of the voltage pulse is utilized in nucleating the bubble and ejecting the ink droplet, the rest of the input energy goes into the printhead and its heat sink. As a result, the printhead temperature increases as the printing process continues. The higher printhead temperature causes an increase in the volume of the ejected ink droplet. Since the droplet volume is one of the variables that determines printed image quality, the quality of the printed image can change as the printhead temperature changes. Accordingly, one of the approaches to control the droplet volume is to modify the input energy to the heating elements, as the printhead temperature changes.

U.S. Pat. No. 4,490,728 discloses one practice currently in use, wherein a two part electrical pulse is applied to the heating elements of a thermal ink jet printer. The pulses comprise a single precursor pulse insufficient to vaporize the ink, followed by a nucleation pulse that produces the bubble and ejects an ink droplet. A certain time delay is incorporated between the two pulses. The purpose of the precursor pulse or pre-pulse is to preheat the ink near the heating elements to provide additional energy to the bubble when it nucleates during the main pulse.

U.S. Pat. No. 5,107,276 discloses a thermal ink jet printhead that is maintained at a substantially constant, but higher than ambient, operating temperature during printing. To prevent printhead temperature fluctuations during printing, the heating elements not being used to eject ink droplets are selectively energized with electrical pulses having insufficient magnitude to vaporize ink.

U.S. Pat. No. 5,036,337 discloses a method and apparatus for controlling the volume of ink droplets ejected from thermal ink jet printheads. The electrical signals applied to the heating elements for generating droplet ejecting bubbles thereon are composed of packets of electrical pulses. The number of pulses per packet and the width and spacing there between are controlled in order to maintain the desired volume of the ejected ink droplets.

When a single pre-pulse is used, the duration of the pre-pulse determines the maximum temperature reached by the ink during the pre-pulse time. If this value is too high, that is, the pre-pulse is too long, nucleation is prematurely initiated which interferes with the main nucleation pulse causing droplet ejection failure. If the appropriate pre-pulse time is used, so that interference with the main pulse does not occur, the pre-pulse width or time is decreased as the printhead temperature is increased, eventually resulting in no pre-pulse before the main pulse. Thus, a single pre-pulse offers a measure of droplet volume control, but only over a relatively small temperature range of about 15° C. Though some droplet volume control is available by prior art techniques, it is important to be able to provide droplet volume control over an extended temperature range.

A further prior art method provides such an extended temperature range by applying multiple pre-pulses to a heating element in which the pre-pulse time period and intervening delay time periods are varied according to the sensed printhead temperature. A system of this type is described in U.S. Pat. No. 6,422,677.

Systems of the type shown in the '677 patent may apply the pre-pulses during the printing operation, for example during a printing swath across a print medium, such as a paper page. It is possible that abrupt changes in the pre-pulse or pulses applied during a print swath may cause visible artifacts in the print. It is an object of this invention to limit the occurrence of abrupt switching of the enable train during a print swath.

SUMMARY OF THE INVENTION

It is an object of the present invention to provide an ink jet printhead having a temperature range over which the volume of the ejected ink droplets may be controlled during a printing swath of the printhead, while avoiding abrupt changes in the prepulses. It is an object of this invention to accomplish this by blending application of sequential pulse trains and thereby providing an averaging of the heat increment applied.

A method is provided for controlling the temperature range of a thermal inkjet printhead during a printing swath. The printhead is constructed having a selectively addressable heating element for each nozzle to produce momentary ink vapor bubbles that eject an ink droplet when the heating elements are addressed with an ink-nucleating electrical pulse in response to data signals received by the printhead. The method of this invention comprises the steps of: sensing the temperature of the printhead; applying a plurality of non-nucleating electrical pre-pulses to the selected heating elements in response to data signals received; applying a nucleating pulse to each of the selected heating elements subsequent to the plurality of non-nucleating pre-pulses to eject ink droplets from the printhead nozzles; storing multiple pulse trains, each configured to provide a predetermined temperature increment, at a predetermined printhead temperature, in a lookup table of a memory element, applying a pulse train to a selected heating element as required by the sensed printhead temperature during a printhead swath, blending the applied enable train by alternating one enable train with another enable train to provide an average temperature increment during a print swath. The blending sequence may end after a print swath is complete and then the temperature control sequence may start over, including the blending sequence if necessary. Also the blending sequence may have a duration which is timed according to a predetermined period.

In another embodiment of the invention, a thermal ink jet printhead for ejecting ink droplets from nozzles therein to a recording medium in response to data signals has a means for controlling the temperature range of the printhead. The printhead is constructed having a plurality of selectively addressable heating elements, one for each nozzle, the heating elements each producing a momentary ink vapor bubble when addressed with an ink-nucleating electrical pulse representative of an image data signal. The printhead includes: a temperature sensor; a power supply; and a control circuit for applying a plurality of non-nucleating electrical pre-pulses to selected heating elements in response to data signals received and a nucleating electrical pulse to the selected heating elements subsequent to the pre-pulses to eject ink droplets from the printhead nozzles. The control circuit is constructed having a controller with a look-up table, and drivers for applying electrical pulses to the heating elements. The look-up table has a series of enable trains arranged according to a predetermined temperature increment at a predetermined printhead temperature. An algorithm within the controller causes the controller to select a enable train from the lookup table according to the temperature of the printhead. During a printing swath, the algorithm directs the controller to blend the applied enable train by alternating one enable train with another enable train to provide an average temperature increment during a print swath. The controller may receive input from a clock to enable the blending sequence for a predetermined time period. In one alternative, the blending sequence can be limited to a printing swath, after which the printhead temperature may be rechecked and another blending sequence may be established if necessary.

BRIEF DESCRIPTION OF THE DRAWINGS

The present invention will now be described by way of example with reference to the accompanying drawings, wherein like reference numerals refer to like elements and in which.

DESCRIPTION OF THE PREFERRED EMBODIMENT

Figure 1:
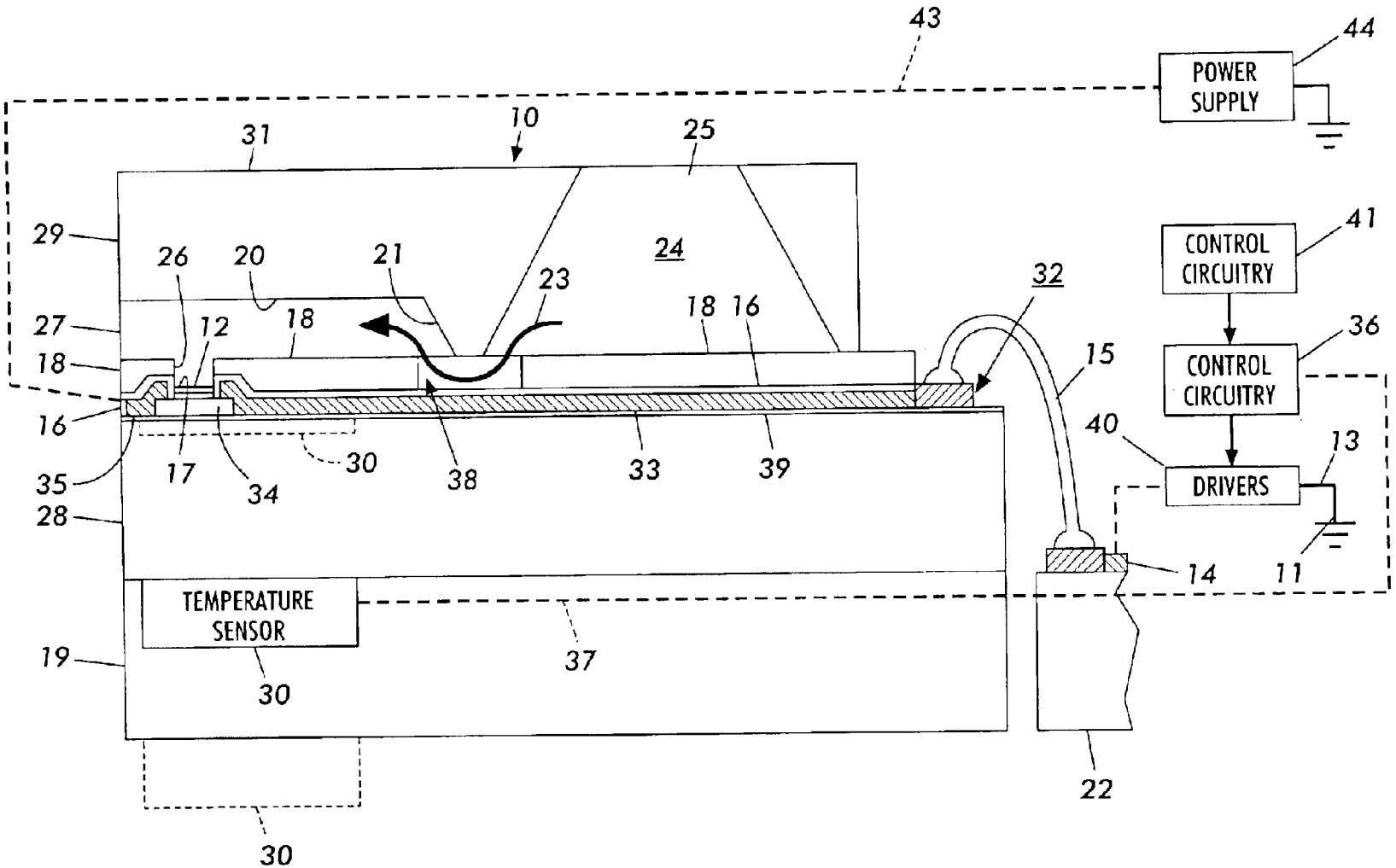
FIG. 1 is a cross-sectional view of a printhead containing the present invention.

In FIG. 1, a schematic cross-sectional view of a thermal ink jet printhead 10 is shown of the type disclosed in U.S. Pat. No. 4,774,530, the relevant portions of which are incorporated herein by reference.

This view is along the length of one of a plurality of ink flow channels 20 in the printhead, and places the nozzles in communication with the printhead reservoir 24. The printhead is composed of a silicon upper substrate or channel plate 31 aligned and bonded to a silicon lower substrate or heating element plate 28, with an intermediate insulative thick film layer 18 sandwiched therebetween. The thick film layer is patterned to expose the heating elements 34, electrode contact pads 32, and to provide a flow-through passageway 38, which connects the reservoir 24 with the channels 20. Ink (not shown) flows from the reservoir 24 through the passageway 38 and around the channel closed end 21 as depicted by arrow 23.

An underglaze layer 39, such as silicon dioxide, is deposited on the silicon heating element plate 28 prior to the forming a set of heating elements, which may be polysilicon or other well known resistive material, such as zirconium boride. Aluminum addressing electrodes 33 and common return 35 are formed, each having contact pads 32, followed by a passivation layer 16 which is deposited over the underglaze layer and the heating elements electrodes. The passivation layer may be any suitable material, such as silicon nitride and/or reflowed polysilicon glass, and is patterned to expose the heating elements and the contact pads. A pyrolytic silicon nitride layer 17 is deposited on the exposed heating elements followed by the deposition of a tantalum layer 12 for cavitational stress protection of the pyrolytic silicon nitride layer 17. For additional electrode passivation, a phosphorous doped CVD silicon dioxide film (not shown) is optionally deposited over the entire heating element plate and removed from the heating elements and contact pads.

Next, an insulative thick film layer 18, such as, for example, polyimide, is formed on the passivation layer 16 or the optional doped CVD silicon dioxide film having a thickness of 25 to 50 micrometers. The thick film layer 18 is photolithographically processed to remove those portions of the layer over each heating element, forming pits 26 which contain the heating elements, forming the passageway 38 which provide the ink flow path from the reservoir 24 to the channels 20, and exposing the contact pads 32.

As disclosed in U.S. Pat. No. Re. 32,572, incorporated herein by reference, the heat element plates are formed from a silicon wafer (not shown), where a plurality of sets of heating elements and their addressing electrodes are patterned and protected from the ink as described above. Then the thick film layer 18 is deposited over the passivated electrodes and heating elements and patterned as described above. The channel plates are likewise formed from a separate silicon wafer (not shown). A plurality of channel plates are produced in the wafer by orientation dependent etching one surface thereof to produce an etched-through recess for each channel plate that will serve as the reservoir 24 and its open bottom serves as the reservoir inlet 25. A set of parallel grooves is etched in the wafer surface for each reservoir to serve as the ink channels, and the two wafers are aligned and bonded together and diced into a plurality of separate printheads 10. The dicing operation opens one end of the grooves to form the nozzles 27 in a front face 29 of the printhead. When the wafers are aligned, the closed end 21 of the channels 20 are positioned over the passageways 38 to complete the ink flow paths from the reservoir to the nozzles, and each channel has a heating element in a pit a predetermined distance upstream from the nozzle. This can be accomplished using Reactive Ion Etching (RIE) as well as Orientation Dependant Etching (ODE).

The individual printheads may be mounted on a heat sink 19 and positioned adjacent a printed circuit board 22 having electrodes 14 which are connected to the contact pads 32 of the printhead addressing electrodes by wire bonds 15. The printhead 10 shown in FIG. 1 may be used in a carriage type printer, as disclosed in U.S. Pat. No. 4,571,599, or a plurality of such printheads may be placed on a full width array bar (not shown) to form a fixed page width printhead. The principal of operation of the present invention is the same for either a carriage type printer or a page width printer, so the invention will be explained with reference to a carriage type printer.

As is well known in the art, the operating sequence of the thermal ink jet systems starts with an electrical pulse through the heating elements in the ink filled channel of sufficient magnitude to substantially instantaneously vaporize the ink contacting the heating element. In order to function properly, heat transferred from the heating element to the ink must be of sufficient magnitude to super heat the ink contacting the surface of the heating element far above its normal boiling point. For water based inks, the temperature is about 280° C. The expansion of the bubble forces a droplet of ink out of the nozzle. After passage of the electrical pulse through the heating element, the heating element is no longer being heated and the bubble collapses. The entire bubble formation/collapse sequence occurs in about 15 μseconds. The channel can be refilled after 50 μseconds dwell time to enable the dynamic refilling factors to become dampened.

As heat is added to the printhead during the printing operation, the volume and velocity of the ejected ink droplet increases. Thus, for high quality printing, the temperature of the printhead and the magnitude of the thermal energy generated by the pulsed heating element must be taken into account and controlled to maintain constant ink droplet volume and velocity.

Figure 3:
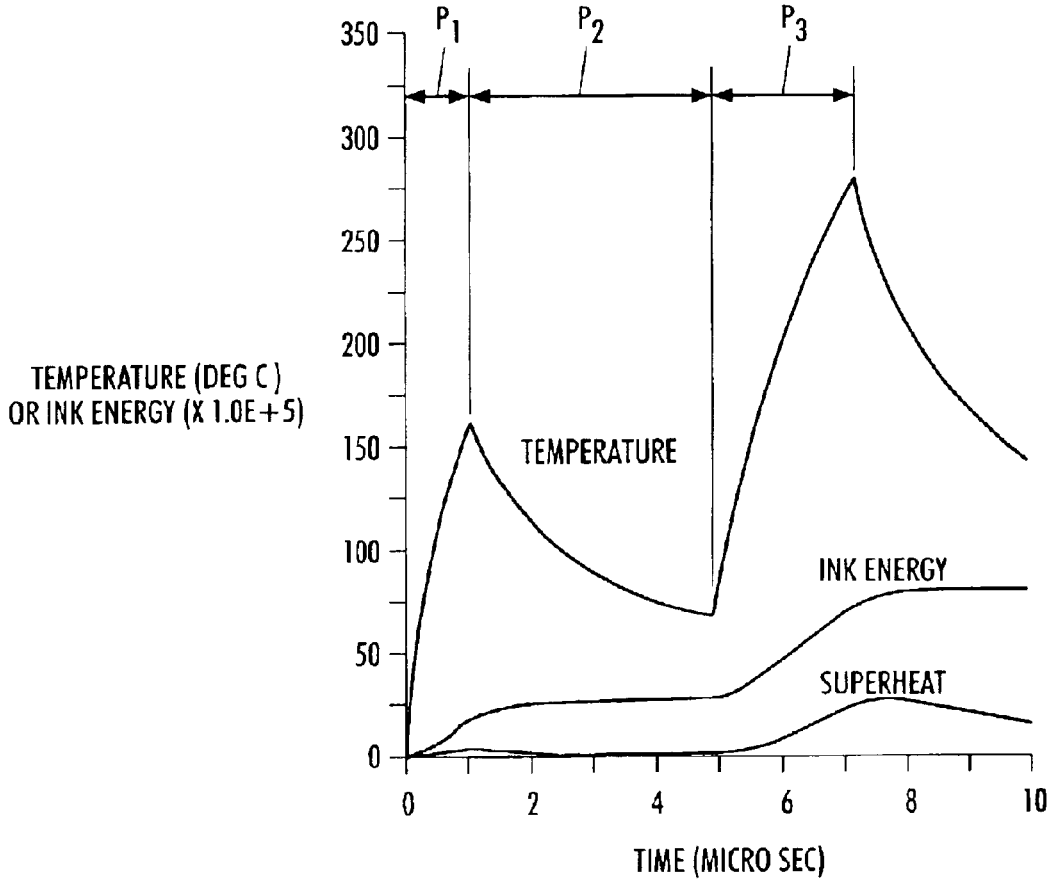
FIG. 3 is plot of the temperature at the ink interface with the heating elements versus time, ink energy versus time, and superheat versus time for a single pre-pulse firing scheme as disclosed in the prior art.

The energy input to the heating elements can be changed by supplying a pre-pulse immediately preceding the main nucleating pulse. One practice currently in use is to provide a single pre-pulse before the main nucleating pulse. A certain time delay is incorporated between the two pulses. The power content in the pre-pulse is significantly lower than that needed for nucleation. The purpose of the pre-pulse is to preheat the ink near the heating element to provide additional energy to the bubble when it nucleates during the main pulse. A typical temperature history at the ink-heating element surface interface for a single pre-pulse firing scheme is shown in FIG. 3, where P1 denotes the pre-pulse duration, P2 denotes the quiescent time between pulses, and P3 denotes the main pulse duration. For the case shown in FIG. 3, P1=0.9 μseconds, P2=4.7 μseconds, and P3=2.1 μseconds. The total pulse time is P1+P2+P3 or 7.7 μseconds.

FIG. 3 also shows the energy stored in the ink and the superheat content of the ink. The superheat is defined as the energy in that portion of the ink that is above 100° C. The pulse duration of the pre-pulse determines the maximum temperature reached during the pre-pulse time. If this value is too high, i.e., if the pre-pulse is too long, bubble generation during this time interferes with the droplet ejecting main nucleation and results in droplet ejection failure. When the printhead is at a lower temperature, the longest possible pre-pulse is applied which will not produce threshold nucleation of the ink, and as the printhead temperature increases, the pre-pulse duration is decreased, eventually resulting in no pre-pulse and only a main pulse. The pre-pulse durations are selected so that the droplet volume is fairly constant over the temperature range. This method provides a droplet volume control over a temperature range of about 15° C.

With a single pre-pulse method, the amount of superheat deposited in the ink is limited because there is generally a relatively long time delay required between the end of the pre-pulse and the beginning of the main pulse. Because of the P2 in the example shown in FIG. 3, the energy deposited in the ink is dissipated in the ink lowering the ink temperature below 100° C. at the time the main pulse P3 is initiated. As seen from FIG. 3, the total energy of the ink during the P2 period is fairly constant. However, the superheat becomes zero. The superheat increases again during the main pulse. Because of this temperature response, the maximum superheat that can be deposited without causing interference with the droplet-ejecting nucleation by the main pulse is limited. Table 1, below, lists the superheat increment possible, and temperature interval for droplet volume control for the single-pre-pulse scheme.

Figure 2:
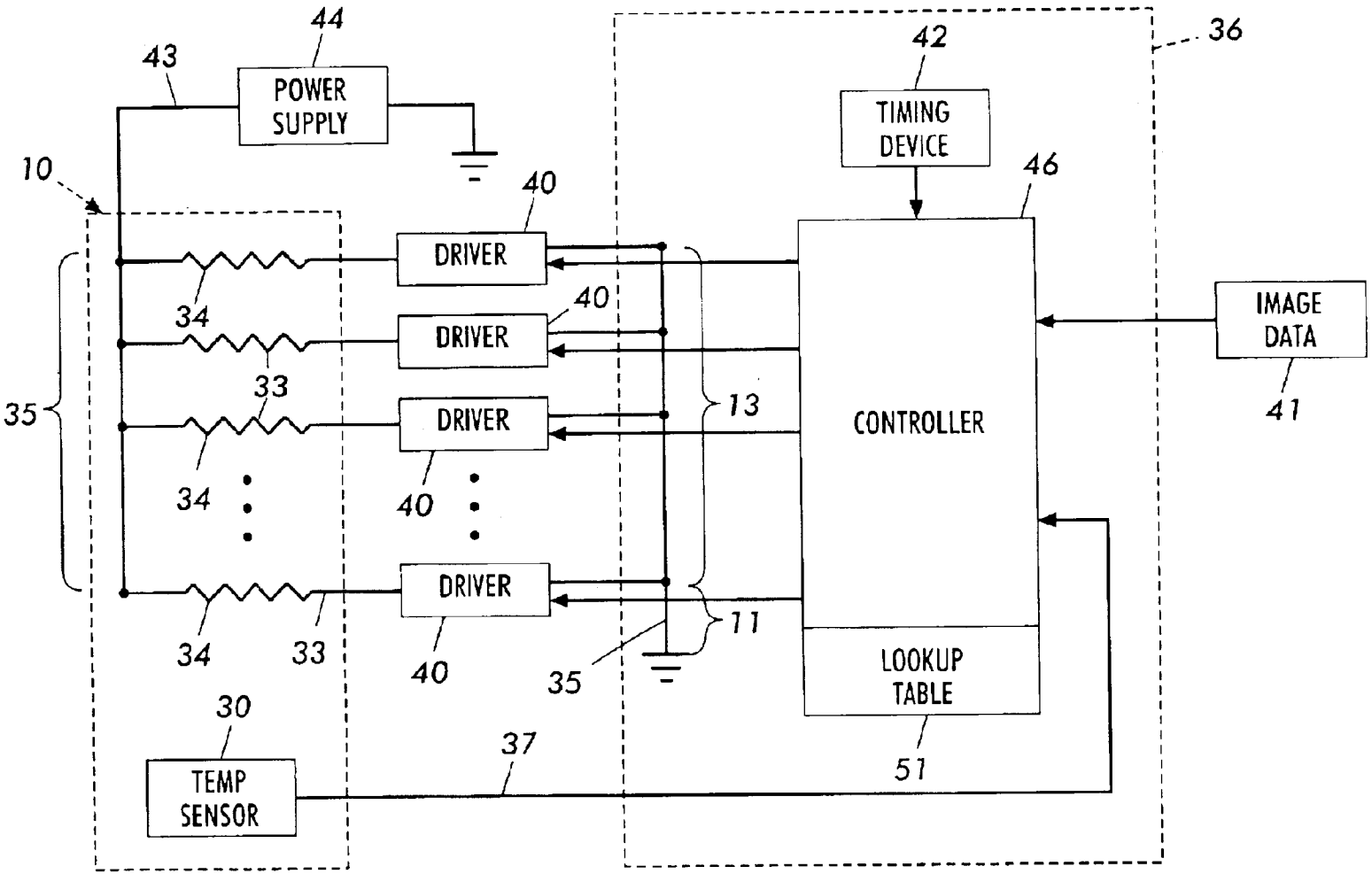
FIG. 2 is a block diagram of a circuit for energizing the heating elements of the printhead of FIG. 1.

The system described in U.S. Pat. No. 6,422,677, the disclosure of which is incorporated herein by reference, uses a large number of short duration pre-pulses prior to the main pulse. The entire pulse train is composed of sequential bits of data provided by the controller 46 (FIG. 2) which provides these data bits at intervals determined by the timing device 42 (FIG. 2). When a data bit from controller 46 is high, current flow in the selected heater element(s) is enabled, and when the data bit from controller 46 is low, current flow in the selected heater element(s) is prevented. Thus, the clocking period of timing device 42 determines the minimum time duration of pulse on times and pulse off times, with all pulse lengths being integer numbers of clocking periods in length.

With an input pulse train composed of a large number of short-duration pre-pulses prior to the nucleating pulse, the ink temperature near the heating element surface is maintained above 100° C. prior to the application of the nucleating pulse. The duration of pre-pulses, the number of pre-pulses, total time for the pulses, and the temperature to which the ink is heated during the pre-pulsing time determine the total superheat in the ink. The higher the superheat, the higher is the droplet volume obtained at a given printhead temperature.

Based upon simulation studies, the temperature range over which droplet volume control may be exercised under the multiple pre-pulsing scheme of the present invention is listed below in Table 2, where the pulsing scheme column lists the clocking period and the total length of the pulse trains. Thus, smaller clocking periods and longer pulse train lengths provide larger temperature control ranges.

TABLE 1

| Single Pre-Pulse Duration/Total Time | Superheat increment possible (nJ/μm2) | Temperature Interval for droplet volume control |
|---|---|---|
| 0.9 μsec/7.7 μsec | 0.0543 | 17° C. |

TABLE 2

| Pre-Pulsing scheme Clock Period, total time | Superheat increment possible (nj/μm2) | Temperature interval for droplet volume control |
|---|---|---|
| 200 nsec, 6.2 μsec | 0.0988 | 30° C. |
| 150 nsec, 8.0 μsec | 0.17 | 53° C. |

Figure 4:
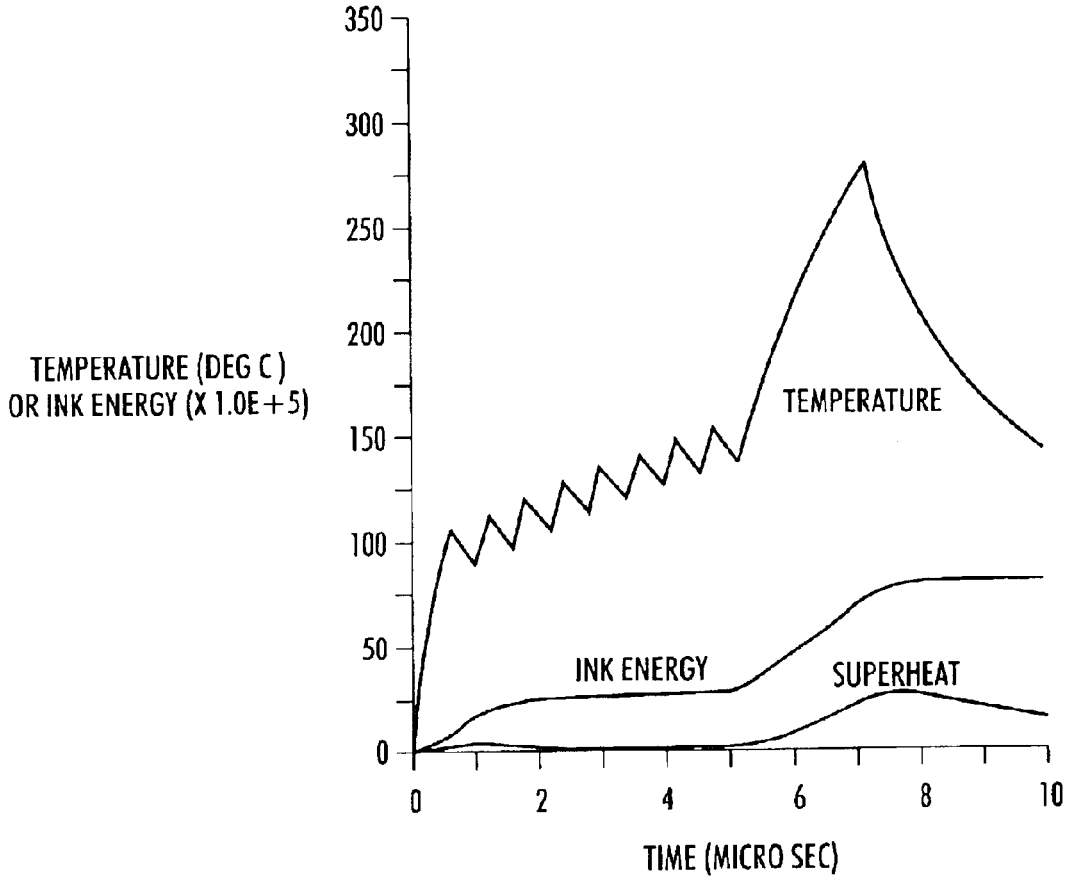
FIG. 4 is a plot of the temperature at the ink interface with the heating elements versus time, ink energy versus time, and superheat versus time for a multiple pre-pulse firing scheme of the present invention.

In FIG. 4, a temperature at the ink and heating element surface interface is shown as a function of time for a multiple pre-pulsing scheme of the present invention. In this system, there are eight pre-pulses and a main nucleation pulse. The first pre-pulse is 0.6 μsec on and 0.4 μsec off, the next seven pre-pulses are each 0.2 μsec on and 0.4 μsec off. The main nucleation pulse is 2.2 μsec on, with a total pulse duration on of 7.4 μsec on. At 25° C. initial printhead temperature, this particular multiple pre-pulsing scheme gives a superheat content of 0.2970 nj/μm2. The multiple pre-pulsing method in the above embodiment substantially increases the temperature range over which the droplet volume can be exercised, and the superheat content of the ink plays an important role in determining the volume of the droplet ejected by the heating element.

Figure 5:
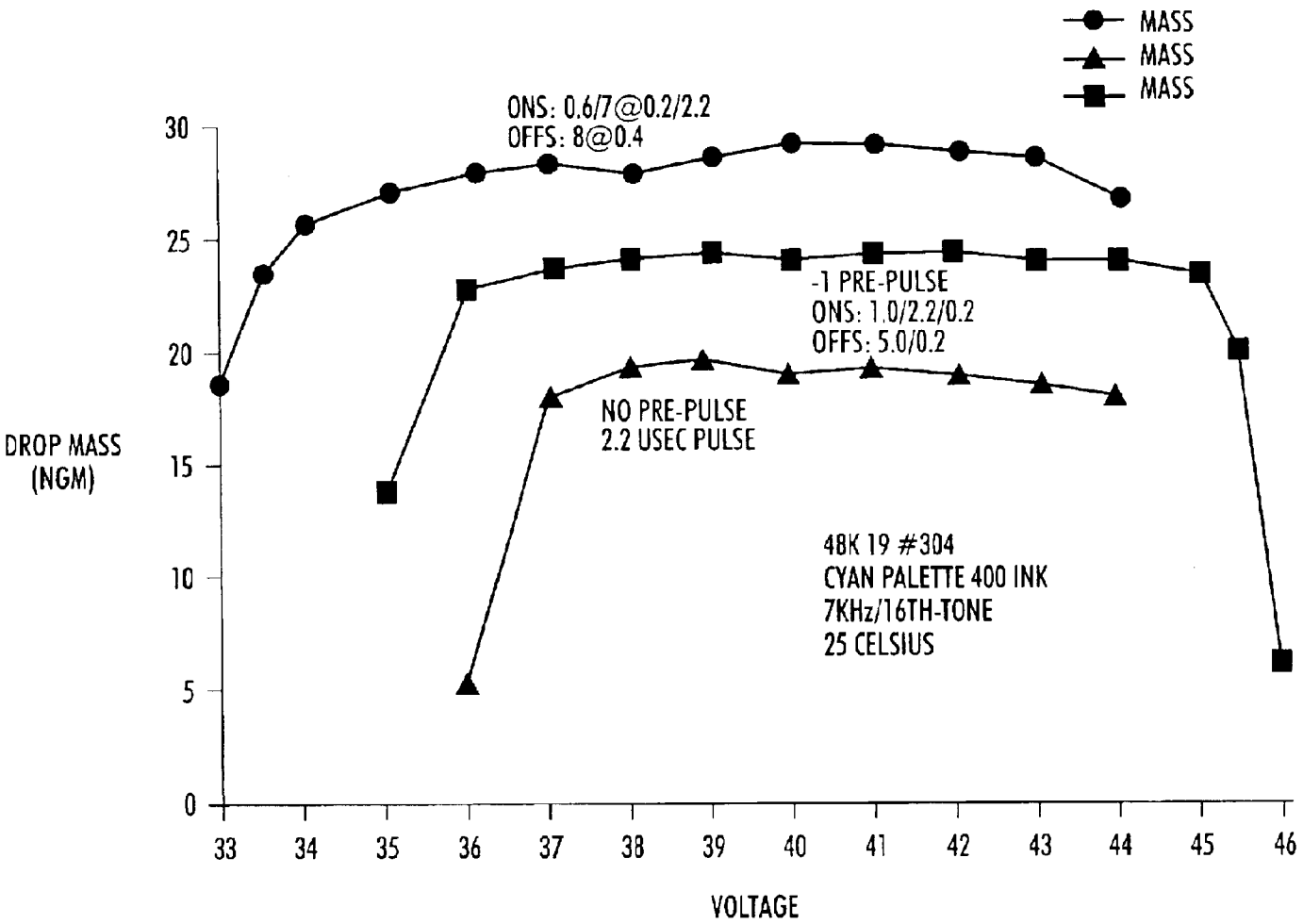
FIG. 5 is a plot of the droplet mass versus voltage for a single nucleating pulse, a single pre-pulse and nucleating pulse, and a multiple pre-pulse and nucleating pulse firing scheme.

Droplet volume was measured at 25° C. at different voltages for a main nucleating pulse, a single pre-pulse prior to a main pulse, and multiple pre-pulses prior to a main pulse and the results are shown in FIG. 5. From this plot, it is seen that the droplet volume obtained with a main pulse only (no pre-pulse) is about 19 picoliters (pi). With a single pre-pulse, the droplet volume is 23 pl, and with the multiple pre-pulse method, the droplet volume is 29 pl. The experimentally determined droplet volume sensitivity to temperature is 0.3 pl/degree C. Using this number a single pre-pulse will have a temperature range for droplet volume control of 13° C. and the multiple pre-pulse system will have a temperature range of 33° C. Thus, a significant extension of temperature range for droplet volume control is available with the multiple pre-pulsing system of the '677 patent. The threshold voltage will change with printhead temperature and the initial number of pre-pulses will vary also with the printhead temperature, which is sensed by temperature sensor 30, as discussed below.

Referring to FIGS. 1 and 2, a temperature sensor 30 is built into the circuit elements of the heating element plate 28 on the surface having the heating elements and prior to mounting of the printhead on the heat sink 19. In this configuration the sensor will not interfere with the attachment of the printhead to the heat sink. The temperature sensor may be optionally located on the opposite surface of the heating element plate 28 that contains the heating elements 34 or on the opposite side of the heat sink as shown in dashed line. The temperature signal line 37 may be a dedicated electrode insulatively mounted on either side of the heat sink. The temperature signals from the temperature sensor are directed to the controller 46 in control circuitry 36 via line 37. A timing device 42, such as a digital clock, and image data signals 41 are directed to the controller. In response thereto, the controller enables the energization of selected heating elements through associated drivers 40. The heating elements 34 are connected to a power supply 44 via line 43 and common return electrode 35. The drivers are connected to the heating elements via addressing electrodes 33, wire bonds 15, and printed circuit board electrodes 14. The drivers 40 are connected to ground through return lines 13 and cable 11.

The electrical pulses are generated by the controller 46 in response to the image data received to energize the heating elements. According to the system of the '677 patent, such pulses are a set of multiple pre-pulses in the form of a preheat (enable) pulse train followed by a nucleating pulse which ejects the ink. The multiple pre-pulses and main pulse may be as described in FIG. 4, discussed above. The pre-pulses are of very short duration and are generally of the order of about 100 nanoseconds or multiples thereof. Each pulse, whether a pre-pulse or main pulse, and the time width between pulses are correlated to the time between one or more clock units generated by the timing device. The control circuitry 36 for selectively applying the multiple pre-pulses and main nucleation pulse includes a controller or microprocessor 46 with a look up table 51 and timing device or clock 42. The controller is connected to each driver 40 in the array of drivers. The voltage supply 44 is connected via line 43 to the common electrode 35 of the heating elements 34 and to ground via the drivers 40, return line 13 and cable 11.

According to this invention, using a system as described above, multiple pre-pulses can be constituted in a wide variety of groups of pulses, referred to as enable trains, having a further variety of time periods with a further variety of time separation. Such enable trains may range in composition from 1–9 pulses or more. The pattern of pulses which comprise each enable train may be simple or complex. From data collected or otherwise empirically calculated, such as those shown in FIG. 5, a particular enable train can be calibrated to provide a particular increment of heat energy to adjust the instantaneous temperature distribution within a thin layer (a micron) of the ink within a print head. Such heat increments can be used to adjust the ink within the print head up or down a predictable increment of temperature. The effect of this adjustment is to increase or decrease bubble volume and thereby effect the energy of the ejected ink droplet.

According to this invention, an array of enable trains comprising multiple pre-pulses are devised and stored in memory 51 which is within or accessible by controller 46. The enable pulse train memory 51 is in the form of a look-up table tabulated according to printhead temperature. Each pulse train will provide an increment of heat to adjust the ink temperature towards the temperature at which a bubble will propagate into the ink channel 20 to expel ink from nozzle 27, as shown in FIG. 1.

The temperature of the printhead is sensed by the temperature sensor 30 and the controller uses the printhead temperature data to select the appropriate enable train from the look up table for application to the heating elements by the drivers. Thus, the controller selects the appropriate enable pulse train to precede the main nucleation pulse. Accordingly, the desired droplet volume is maintained as the printhead temperature changes during the printing operation.

As previously stated, when printhead temperature adjustment occurs during a printing operation, visible artifacts may form in the printed image. It is, therefore advantageous, according to this invention, to modulate the change in the enable train to avoid abrupt changes in the heat applied to the printhead. To accomplish this purpose, the controller is provided with an algorithm which directs controller 46 to select two pulse trains, for example, enable trains that fall on either side of the sensed printhead temperature in the lookup table. Controller 46 is then directed to alternatingly apply each of the selected enable trains, thereby blending said enable trains. The blended pulse trains provide a heat increment, which is the average of the heat increment of the two enable trains. In this manner the process changes the drop volume, even as quickly as the next drop. The drop volume is therefore more directly controlled because the average power of the droplet is also changed, as well as the heating rate of the print head.

In operation, a method is provided for controlling the temperature of ink in a thermal inkjet printhead 10 during a printing swath. As described above, printhead 10 is constructed having a selectively addressable heating element 28 for each nozzle 27. The heating elements 28 are designed to produce momentary ink vapor bubbles that power the ejection of an ink droplet from nozzle 27 when the heating elements are addressed with an ink-nucleating electrical pulse. The pulse is generated by controller 46 through drivers 40 in response to image data signals received by the printhead.

Figure 6:
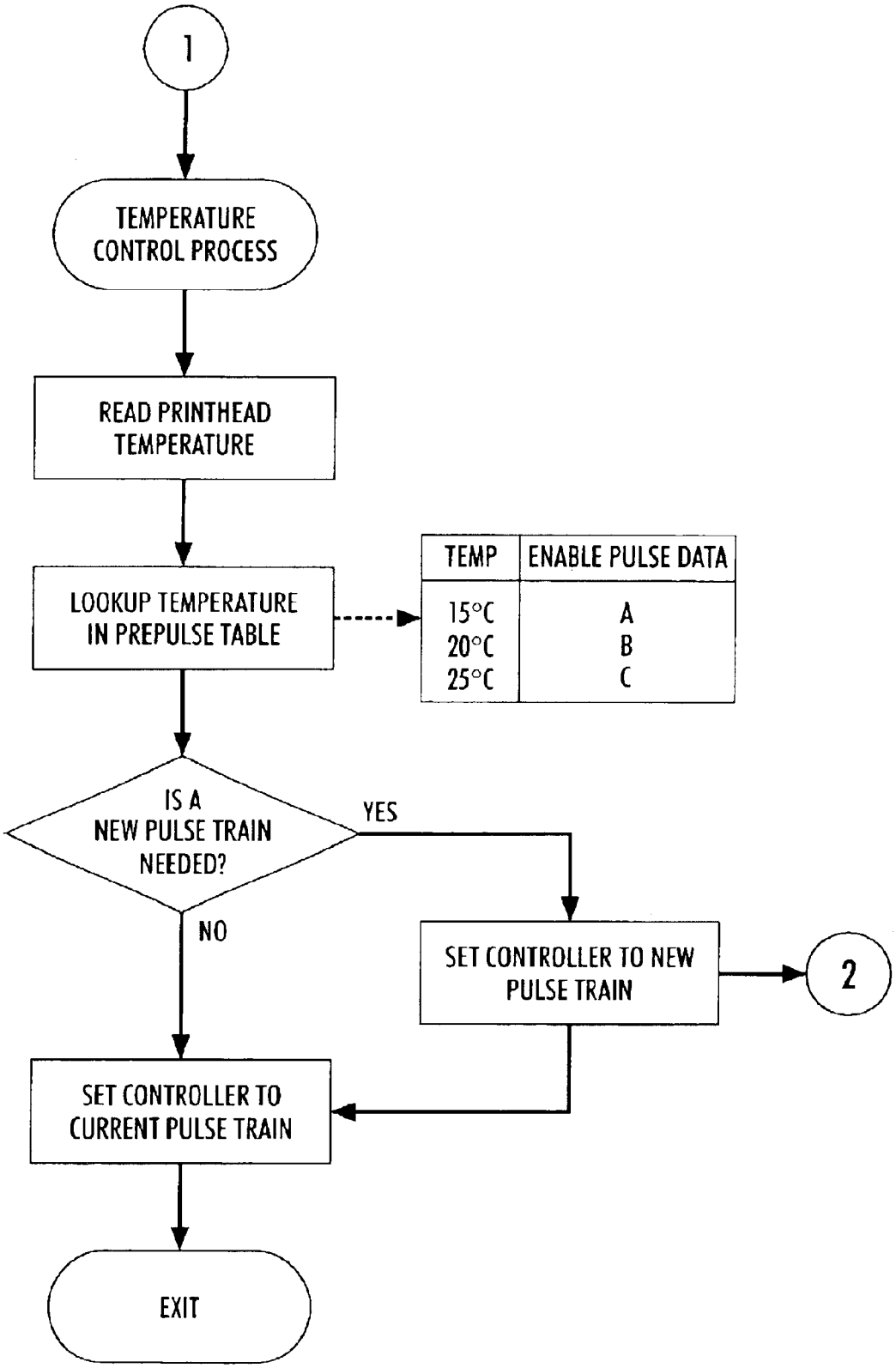
FIG. 6 is a flow diagram showing the operation of the temperature control sequence.

In the method of this invention, as illustrated in the flow diagram of FIG. 6, the temperature of the printhead 10 is sensed by sensor 30 and read by controller 46. In response to the temperature reading, controller 46 selects an enable pulse train from the table of memory 51. The enable pulse train consists of a plurality of non-nucleating electrical pre-pulses that will provide a known increment of heat. The enable train is applied to the selected heating element in response to a temperature reading at the printhead. The application of the enable train is followed by a nucleating pulse to the selected heating element to eject ink droplets from the printhead nozzles. The enable train affects an adjustment of the instantaneous heat energy within a thin layer of the surface of the ink within the printhead.

Figure 7:
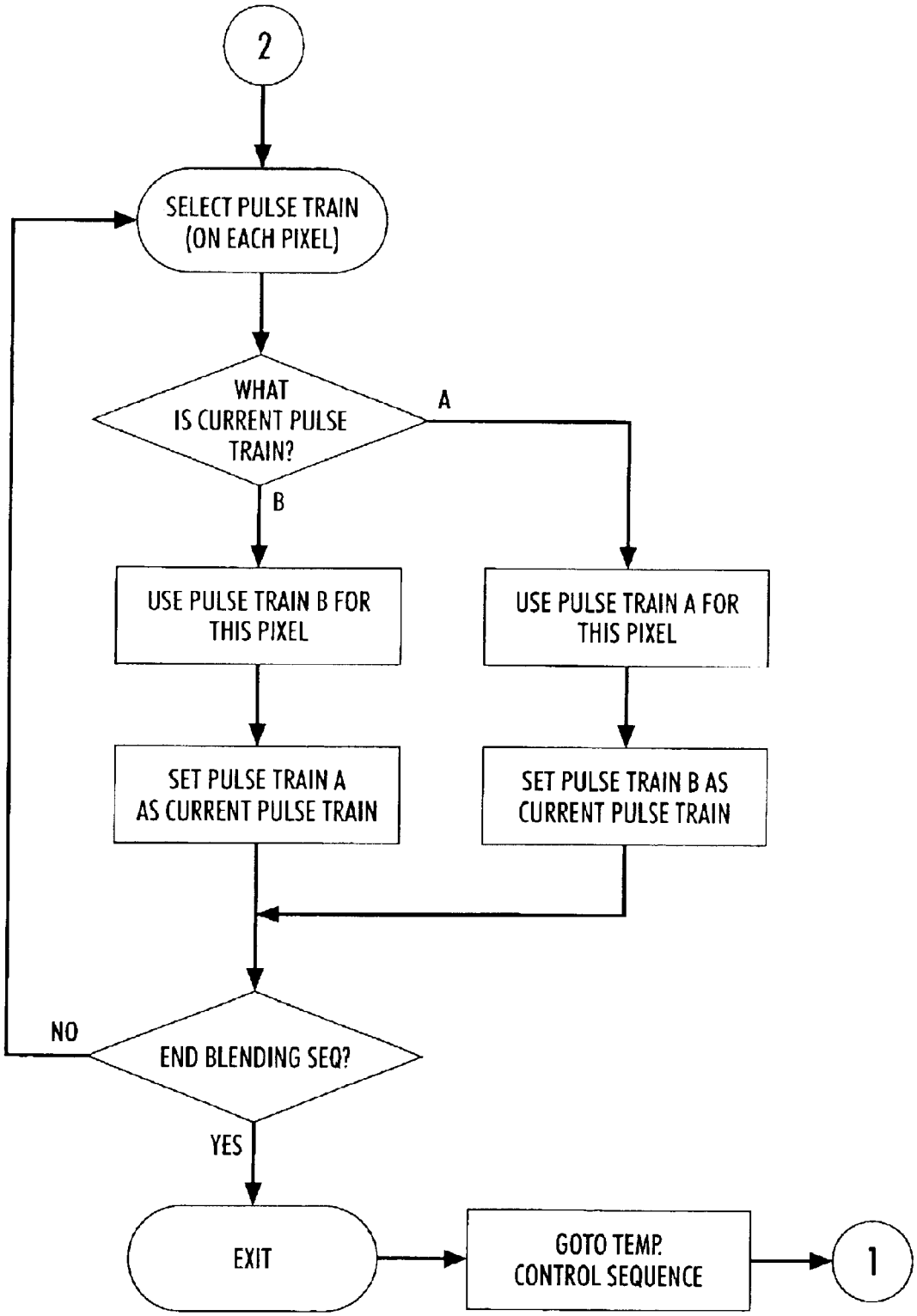
FIG. 7 is a flow diagram showing the operation of the blending sequence.

Based on compiled data and empirical calculation, multiple enable pulse trains are configured to provide a predetermined heat increment at a predetermined printhead temperature. A series of such enable trains are generated to suit the particular printhead used and stored in a lookup table of memory 51. A selected enable train is applied to heating element 28 as indicated by the sensed printhead temperature during a printhead swath. As illustrated in FIG. 7, a blending sequence is initiated when a change in the enable train is selected by controller 46.

In the blending sequence, the applied enable train is blended by alternating one enable train with another enable train to provide an average heat increment to the ink during a print swath. The blending sequence may end after a print swath is complete and then the temperature control sequence may start over, including the blending sequence if necessary.

The application of an enable train may occur as often as before each pixel is printed, or as otherwise required or desirable. When the controller 46 does not change the enable pulse train, the current enable train is repeated and no blending sequence is needed. The blending sequence may be particularly advantageous, when the printhead temperature is between successive enable pulse train increments.

Figure 8:
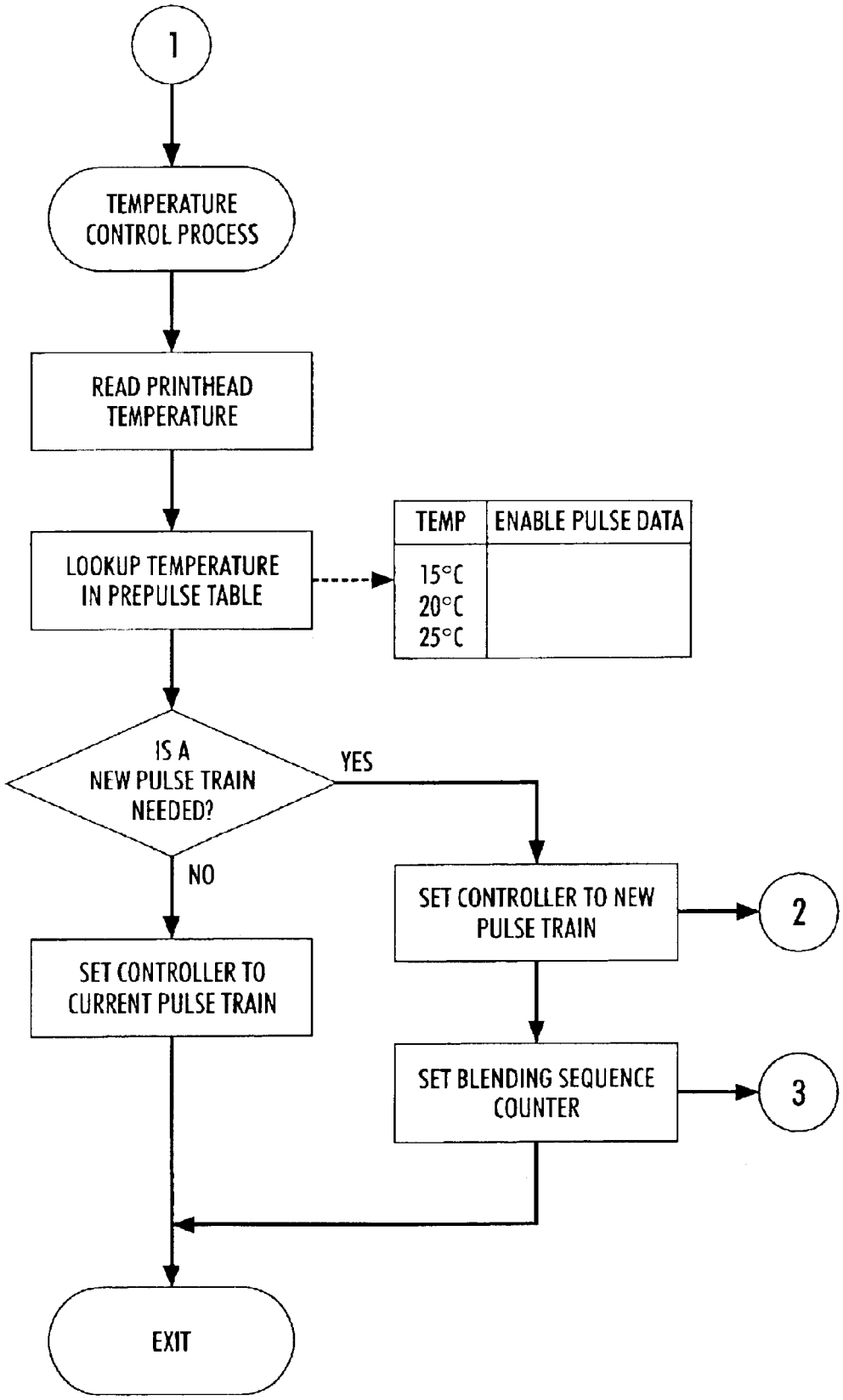
FIG. 8 is a flow diagram of the temperature control sequence in an alternate embodiment of this invention.
Figure 9:
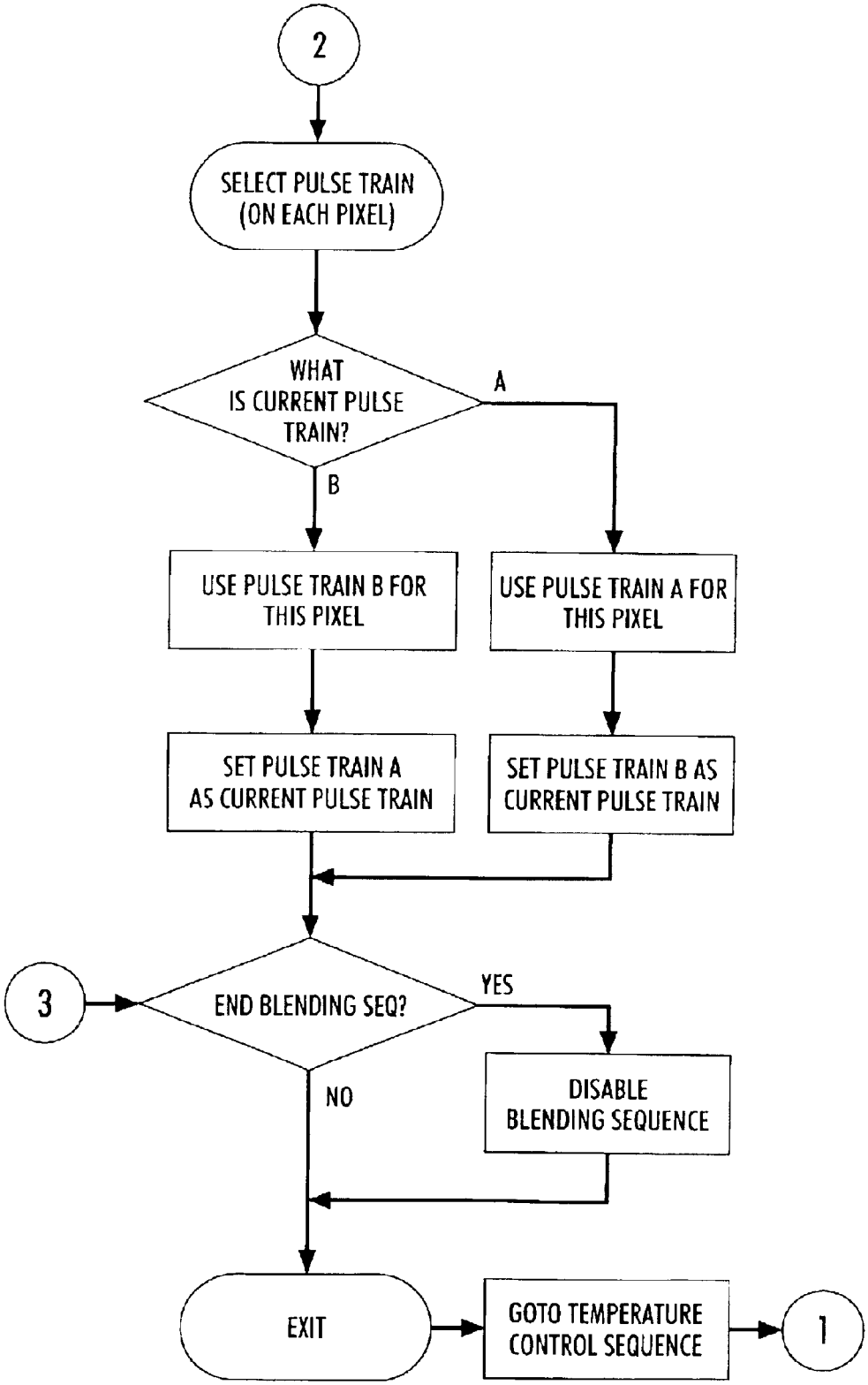
FIG. 9 is a flow diagram of the blending sequence of an alternate embodiment of this invention.

In an alternative embodiment, as shown in FIGS. 8 and 9, the blending sequence is applied for a predetermined duration. Timing device 42 may be an appropriate counter which can be used to allow controller 46 to track the period during which the blending sequence is enabled. Upon the expiration of the predetermined period, the blending sequence is disabled and the temperature control sequence continues.

The blending sequence of this invention may be implemented by firmware imbedded in controller 46, by an ASIC programmed to provide the alternating application of several pulse trains, or other means well known in the art. The blending sequence itself may be modified, for example, a first enable train could be applied for 3 pixels followed by a second enable train for 3 pixels, instead of alternating for a single pixel.

Although the foregoing description illustrates the preferred embodiment, other variations are possible and all such variations as will be apparent to those skilled in the art are intended to be included within the scope of this invention as defined by the following claims.

What is claimed is:

1. A method for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said method comprising the steps of:

sensing the temperature of the printhead;

applying a plurality of non-nucleating electrical pre-pulses to a selected heating element in response to data signals received;

applying a nucleating pulse to said selected heating element subsequent to the application of said plurality of non-nucleating pre-pulses to eject ink droplets from a printhead nozzle operatively associated with said selected heating element;

wherein said step of applying a plurality of non-nucleating electrical pre-pulses further comprises the steps of:

compiling a series of enable trains comprising a plurality of non-nucleating pre-pulses, each of said enable trains designed to provide a predetermined heat increment at a predetermined printhead temperature;

storing said series of enable trains in tabular form according to printhead temperature;

selecting a first enable train as indicated by the sensed temperature of the printhead;

applying said first enable train to a selected heating element to preheat said ink during a printing operation; and blending said first enable train by alternating the application of said first enable train with a second enable train to provide an average heat increment to said ink during a printing operation.

2. A method for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said method, as described in claim 1, wherein said blending is enabled when said sensed printhead temperature indicates a change in said first selected enable train to said second selected enable train.

3. A method for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said method, as described in claim 1, wherein said blending is enabled during a swath of said printing operation.

4. A method for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said method, as described in claim 1, wherein said blending is enabled for a predetermined timed interval.

5. A method for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said method, as described in claim 1, wherein said alternating between the application of said first and second enable trains occurs after every pixel.

6. A method for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said method, as described in claim 1, wherein said alternating between the application of said first and second enable trains occurs after a predetermined number of pixels.

7. A system for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said system comprising:

a sensor for sensing the temperature of the printhead and generating a signal indicative thereof;

a first driver for generating a plurality of non-nucleating electrical pre-pulses;

a second driver for generating a nucleating pulse to eject ink droplets from a printhead nozzle operatively associated with said selected heating element;

a controller for selectively activating said first driver to apply said plurality of non-nucleating electrical pre-pulses to a selected heating element in response to data signals received, said controller further activating said second driver to apply said nucleating pulse to said selected heating element subsequent to the application of said plurality of non-nucleating pre-pulses;

a memory operatively associated with said controller to allow said controller to store a series of enable trains comprising a plurality of pre-pulses, each of said enable trains designed to provide a predetermined heat increment to said ink at a predetermined printhead temperature, said series of enable trains being stored in tabular form according to printhead temperature;

an algorithm operatively associated with said controller to cause said controller to select a first enable train as indicated by the sensed temperature of the printhead, to apply said first enable train to a selected heating element to preheat said ink during a printing operation and to blend said first enable train by alternating the application of said first enable train with a second enable train to provide an average heat increment to said ink during a printing operation.

8. A system for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said system, as described in claim 7, wherein said algorithm causes said blending to be enabled when said sensed printhead temperature indicates a change in said first selected enable train to said second selected enable train.

9. A system for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said system, as described in claim 7, wherein said algorithm causes said blending to be enabled during a swath of said printing operation.

10. A system for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said system, as described in claim 7, wherein said algorithm causes said blending to be enabled for a predetermined timed interval.

11. A system for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said system, as described in claim 7, wherein said algorithm causes said alternating between the application of said first and second enable trains to occur after every pixel.

12. A system for controlling the temperature of ink within a thermal ink jet printhead, the printhead having a selectively addressable heating element for each nozzle thereof to produce momentary ink vapor bubbles that eject an ink droplet when the heating elements are addressed with an ink-nucleating electrical pulse in response to data signals received by the printhead, each of said ink droplets representing a pixel of an image to be printed, said system, as described in claim 7, wherein said algorithm causes said alternating between the application of said first and second enable trains to occur after a predetermined number of pixels.

* * * * *